US006944993B1

(12) United States Patent
Jilk et al.

(10) Patent No.: US 6,944,993 B1
(45) Date of Patent: Sep. 20, 2005

(54) PANEL CONSTRUCTION AND FABRIC RETAINER

(75) Inventors: Larry M. Jilk, Apple Valley, MN (US); Danny A. Thompson, Lakeville, MN (US)

(73) Assignee: Rosemount Office Systems LLC, Lakeville, MN (US)

( * ) Notice: Subject to any disclaimer, the term of this patent is extended or adjusted under 35 U.S.C. 154(b) by 4 days.

(21) Appl. No.: 10/446,484

(22) Filed: May 28, 2003

Related U.S. Application Data

(60) Provisional application No. 60/385,187, filed on May 30, 2002.

(51) Int. Cl.[7] ..... E04H 1/00

(52) U.S. Cl. ..... 52/36.1; 52/239; 160/398; 160/351

(58) Field of Search ..... 52/36.1, 481.2, 52/239, 241, 242, 653.2, 730.4, 731.2; 160/398, 160/351, 380, 404; 312/406, 406.2, 400

(56) References Cited

U.S. PATENT DOCUMENTS

| | | | | |
|---|---|---|---|---|
| 3,766,693 | A | 10/1973 | Stark et al. | |
| 3,871,153 | A | 3/1975 | Birum, Jr. | |
| 4,144,924 | A | 3/1979 | Vanden Hoek | |
| 4,188,764 | A | 2/1980 | Gode | |
| 4,213,493 | A | 7/1980 | Haworth | |
| 4,375,010 | A | 2/1983 | Mollenkopf | |
| 4,391,073 | A * | 7/1983 | Mollenkopf et al. | 52/241 |
| 4,891,922 | A | 1/1990 | Hozer et al. | |
| 5,025,603 | A | 6/1991 | Johnson | |
| 5,070,666 | A | 12/1991 | Looman | |
| 5,238,515 | A | 8/1993 | Insalaco et al. | |
| 5,339,576 | A | 8/1994 | Fussler | |
| 5,377,466 | A | 1/1995 | Insalaco et al. | |
| 5,689,924 | A * | 11/1997 | Mason | 52/239 |

OTHER PUBLICATIONS

Werner Wasner, "The Process of Contoured Tubing Manufacturing", Feb. 28, 2002, Practical Welding Today, pp. 1-3.*

* cited by examiner

*Primary Examiner*—Naoko Slack
(74) *Attorney, Agent, or Firm*—Westman, Champlin & Kelly, P.A.

(57) ABSTRACT

A modular office panel comprises a panel that has outer peripheral frame members made of formed tubes. The tubes have outer edge walls, side walls, and inner edge walls that are positioned to the interior of the frame. The inner edge walls are formed of side flanges that overlap in the center and which are welded together to enclose the tube and make it rigid. A fabric retainer channel is welded to the inner edge wall of each frame tube and has wall portions that extend outwardly from outer sides of the tube and side walls spaced from and generally parallel to the side walls of the tube. The fabric retainer channel side walls have edge portions extending inwardly back toward the tube side walls and which inwardly turned edge portions include teeth for retaining fabric in place. The fabric retainer channel has a base wall with tabs that extend inwardly from the inner wall and which are used for holding a central divider wall in place within the periphery of the panel formed by the frame members.

11 Claims, 4 Drawing Sheets

PANEL CONSTRUCTION AND FABRIC RETAINER

This application refers to and claims priority from U.S. Provisional application Ser. No. 60/385,187 filed May 30, 2002, the contents of which is incorporated by reference.

BACKGROUND OF THE INVENTION

The present invention relates to a modular office divider panel that has a peripheral tubular frame constructed to permit fabric covering for the panel sides to be retained simply and easily. The fabric retainer provided is a separate piece welded to a structural tube of the frame, and which has inwardly directed teeth for holding a fabric stretched across the surface of the frame.

Various panel frame constructions for modular office panel systems have been advanced. The frames surround a space that is blocked with a core and covering to make a divider panel. Core constructions generally include inner dividers of hard board, with layers of insulation on the hard board and a cover of a fabric material to provide the desired aesthetic appearance to the exterior of the modular panel.

The divider panels are normally used for forming office work space, and will also be adaptable to support cabinets, worktops, and accessories. Thus, provisions have to be made for inserting hooks or hangers for such items, as well as for retaining the fabric covering stretched tightly for a good aesthetic appearance.

SUMMARY OF THE INVENTION

The present invention relates to a modular divider panel construction for offices which have fabric covering a central support wall covered with a filling of fiberglass insulation or the like. The divider panels are constructed with a formed metal peripheral frame that supports a fabric attachment member that is for attaching and holding the edges of a fabric cover and retaining the fabric cover in position.

The panel frame is an open peripheral frame, made of strong easily formed tubes. As shown the fabric attachment member comprises a channel. The base of the fabric attachment channel has partially punched out tabs that are bent to protrude from the inner sides of the fabric attachment channels into the space surrounded by the panel frame to support a center hardboard divider wall. The divider wall fills the interior space surrounded by the frame. A layer of fiberglass material is than put on each of the opposite sides of the center divider board or wall and a fabric is stretched over the fiberglass material layer and retained on the fabric attachment member on the peripheral frame.

Attachment members for holding the fabric in place are on all sides of the frame and have in-turned rows of teeth formed to engage the edges of the fabric cover and hold it securely once the fabric has been stretched over the frame opening and moved into engagement with the teeth. The tubes are enclosed with overlapping flanges on the base wall that permits easily forming the tube. The overlapping flanges are welded at the junction seam to complete the making of the frame tubes.

DETAILED DESCRIPTION OF THE PREFERRED EMBODIMENTS

Figure 1:
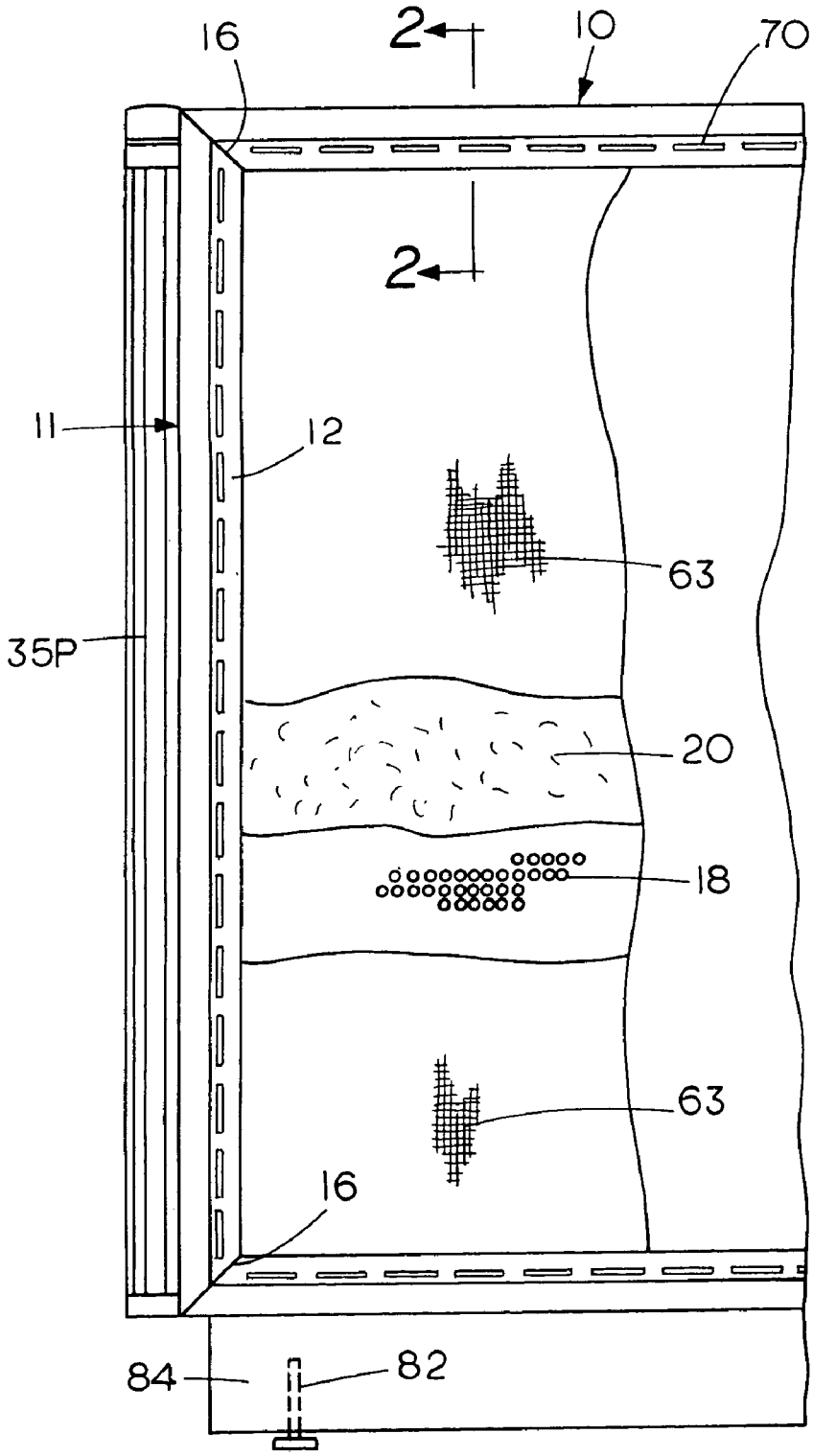
FIG. 1 is a fragmentary view of one side of a typical office panel having a framework made according to the present invention.

In FIG. 1, an office divider panel 10 is shown fragmentarily, and it is shown with sections of the outer fabric material cover removed and other layers, such as an insulation layer broken away. The panel 10, has a peripheral frame 11, comprising spaced side vertical frame members 12, and top and bottom horizontal frame members 14 that are joined together at corners 16 to form an enclosed rectangular opening that is circumscribed with the frame members 12 and 14. The panel assembly 10 includes a center hard board or semi-rigid panel 18, covered on either side with layers of suitable fiberglass or other insulation material shown at 20 (FIG. 1) and 22, in FIG. 2.

Figure 2:
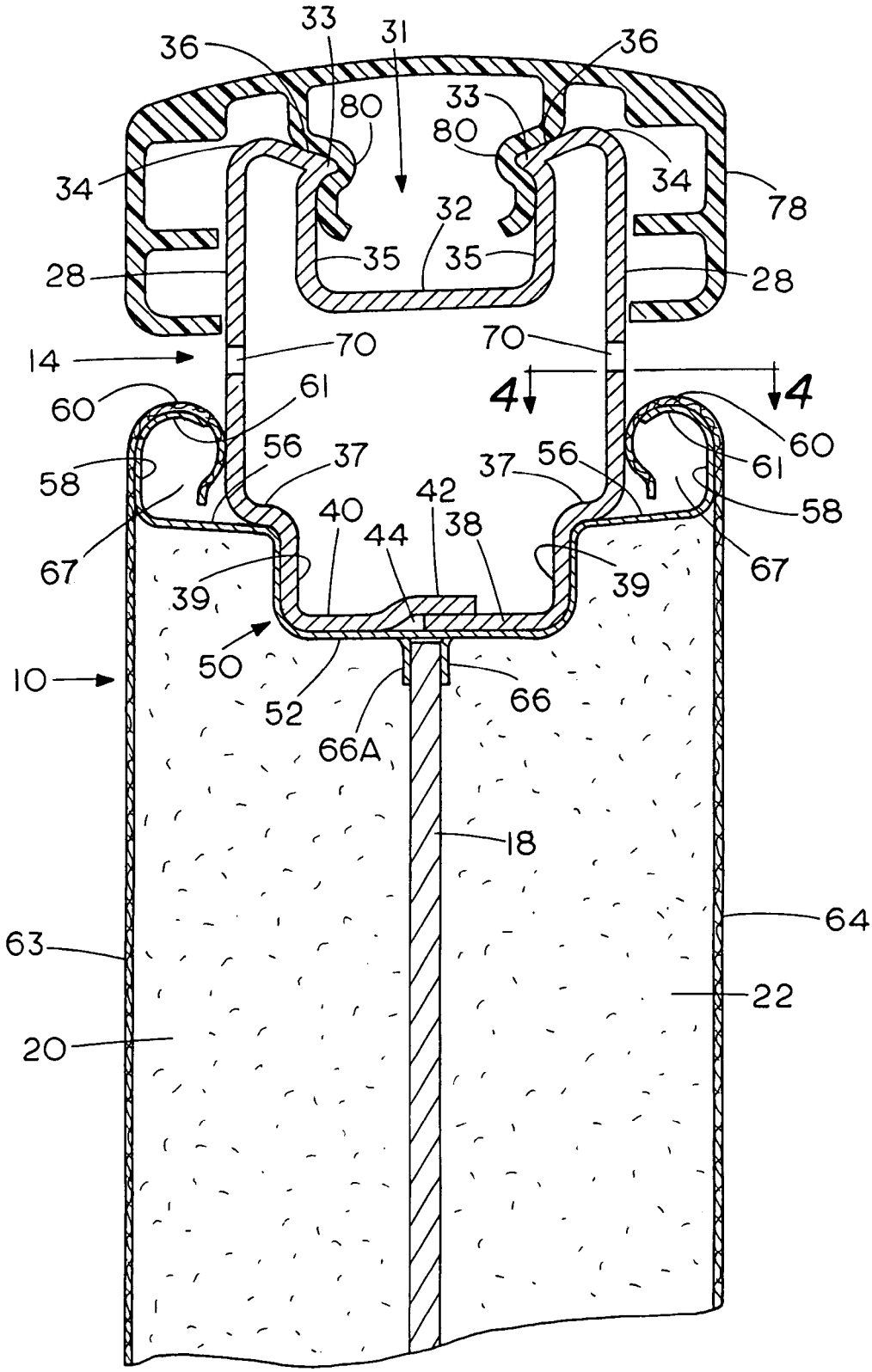
FIG. 2 is a sectional view taken generally along line 2—2 in FIG. 1.
Figure 3:
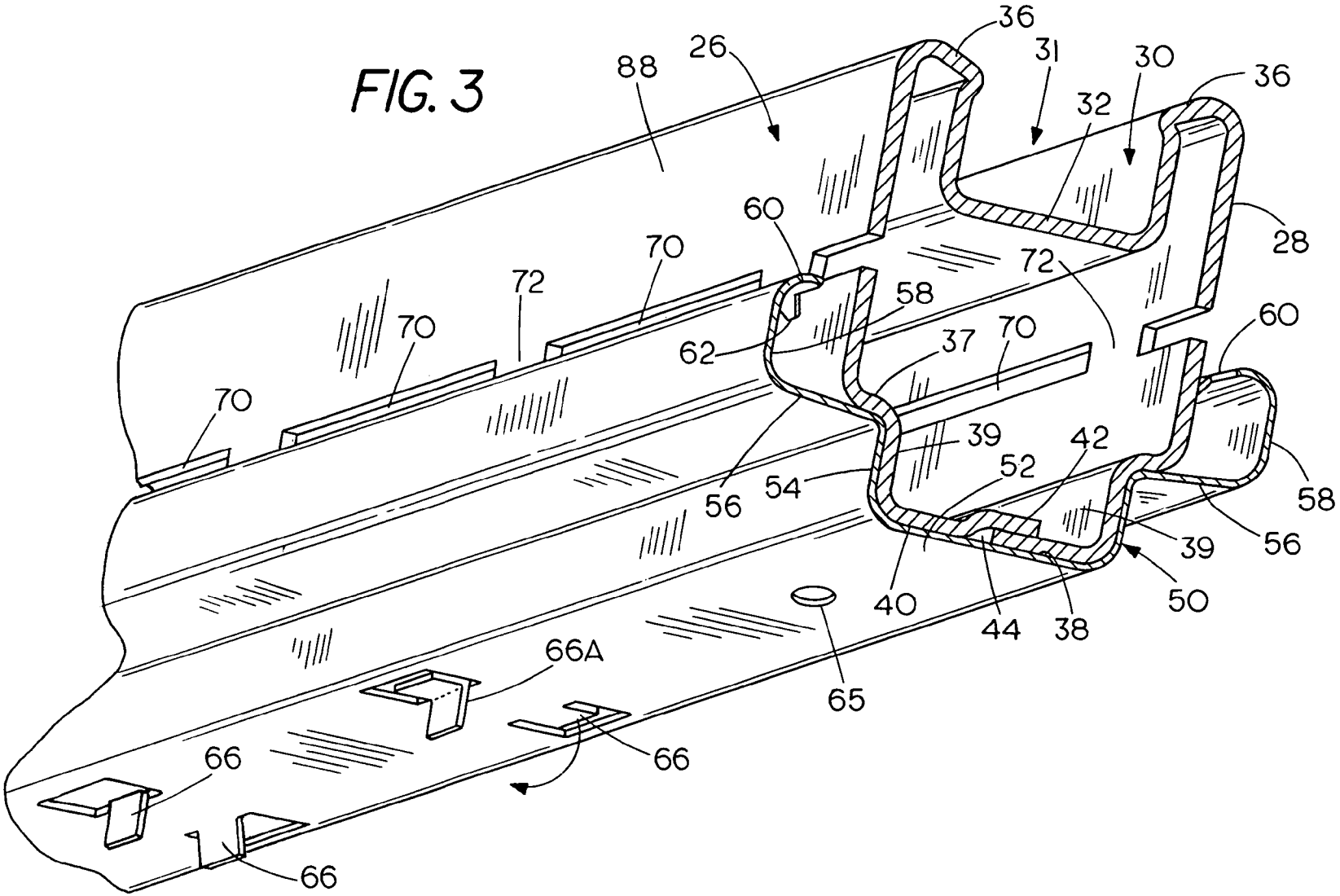
FIG. 3 is a schematic perspective view of a section of a panel frame tube member.
Figure 4:
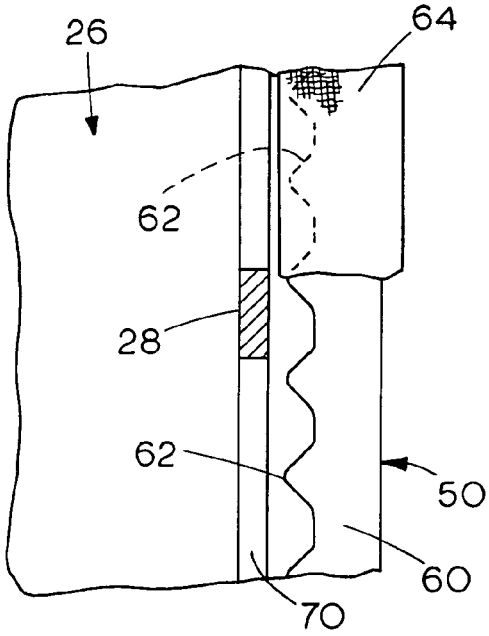
FIG. 4 is a fragmentary sectional view taken on line 4—4 in FIG. 2.

The frame members 12 and 14 are all substantially identically formed. As perhaps best seen in FIG. 3, each of the frame members 12 and 14 (frame member 14 is shown in FIG. 2) comprise a formed metal enclosed periphery tube 26, including side walls 28, and an outer edge wall 30 that faces to the outside of the frame. The outer edge wall 30 is formed to have a channel shaped, outwardly open recess 31 with a base wall 32 which joins side walls 35 that are joined to inwardly tapered wall portions 36 of outer edge wall 30. Rounded corners 34 connect the inwardly tapered wall portions 36 with the outer surfaces of side walls 28.

The vertical frame members 12 may support a suitable corner post such as that shown at 35 in FIG. 1. Suitable attachment devices hold the corner posts at the ends of the frames, as is known. These posts are used for joining adjacent panels 10 end to end, or joining panels at a junction of two panels 10 positioned at an angle relative to each other. The recess 31 and tapered walls 36 are formed to receive and snap in a PVC of other plastic end cap, at the top and also at an exposed vertical end frame members. A junction latch protrusion 33 is formed for receiving the end cap.

The side walls 28, 28 of the frame members are formed to have inwardly extending shoulders 37 at inner sides, and include inset wall portions 39 parallel to the walls 28 that extend to the inner side edge of the frame. The wall portions 38 and 40 of the formed tube 26 form overlapping flange or wall portions. One inset wall portions 39 joins the inwardly extending flange 38, and the other wall portion 39 joins a flange 40 that is formed to have an outer surface that is parallel to the outer surface of flange 38, but which also has an offset 42 that is on the inside of and overlaps the flange 38.

The flange 38 and flange 40 are than welded together at their external junction line, generally as shown at 44 to form the inner or bottom wall of the frame tube. This makes the tube very rigid, but yet makes it easy to form because it can be pre-punched in a flat state, and formed, with the final closing being to hold the lip 42 over the flange 38, for welding.

A fabric retainer channel 50 is formed to have a base portion 52 that mates with the inner side wall of the frame tube, formed by flanges 38 and 40. The channel 50 has wall sections 54 that extend up along the wall portions 39. The fabric retainer channel 50 then has bent out flanges 56 that flare sideways outwardly from the walls 54, and mate with and rest on wall portions 37.

The side walls 58 of the fabric retainer channel 50 extend upwardly, and then the side walls are reverse bent in toward walls 28 of the frame tube 26 to form edge portions as shown at 60. Edge portions 60 of the side walls of the fabric retainer channel have teeth 62 formed thereon, and the ends of the teeth are close to, but spaced from the side walls 28 of the frame tube. The edge portions 60 and flanges 56 are made springy enough so that they will resiliently yield to permit fabric cover layers 63 and 64 to fit over the teeth 62. The fabric cover layers are on both sides of the panel 10 and stretched over the respective wall portions 58 to fit over the reverse bend teeth 62. The teeth 62 engage the respective fabric panel and retain it in place. The fabric can be stretched between the top and bottom frame members 14, as well as between the end frame members 12 and put into position over the teeth 62 and held there under tension.

The base wall 52 of the fabric retainer channel 50 has a series of holes 65 punched therein, and spaced along the length of the channel 50. The edges of the holes 65 are used for welding the base wall 52 to the bottom wall of the tube, which bottom wall is formed by flanges 38 and 40. The welding is done from the under or inner side of the frame members. The welds hold the fabric retainer channel 50 in position on the perspective frame members.

Additionally, the base wall 52 of the fabrication channel 50 has partially punched out tabs shown at 66 and 66A that are bent down from wall 52. These tabs 66 and 66A are transversely aligned and when bent down are spaced apart to form retainers for holding the center divider wall 18 in position on the interior of the peripheral frame. The tabs 66 are on the top and bottom and the end frame members. The tabs 66 and 66A will be longitudinally spaced at regular intervals, for example approximately every six inches, for retaining the divider wall 18 in position.

The frame members 12 and 14 have to support accessories, such as cabinets, shelves, and worktops, and in order to provide for receiving support hooks, a series of slots 70 can be formed in the side walls 28 of the frame members. These slots are spaced to form bridge walls 72 between the slots. The slots will receive retaining hooks that fit into the slots and then latch over the bridge walls 72.

A plastic edge cap 78 can be provided on the outer side of the top frame member or an exposed end frame member, and is molded to form a smooth appearance, with fingers 80 that will snap into the prospective junction latch 33 between the vertical wall portions 35 of recess 31 and the sloped wall portions 36. The caps 78 are for decorative purposes.

The lower frame members 14 of the panel are adapted to be supported on legs 82, as shown at FIG. 1. Suitable raceways 84 for electrical wiring, and communication wiring can also be provided for office use.

The frame members can be secured (welded) together to form the peripheral frame, as is normally done, with the fabric retainer channel 50 in place. The wall 18 and insulation are put into place. The fabric cover panels then can be stretched over the entire opening defined by the peripheral frame and over the fabric retainer channel. The rounded corner surface 61 at the bend portion 60 prevents the fabric from tearing while the teeth 62 will engage and hold the fabric in place. The edges of the fabric are forced around the teeth 62 and into the recess 67, where it can be stored.

The insertion of the fabric cover around the teeth is preferably done using a long blade equal to the length of the channel 50. The insertion can be done using a power operator for the blade.

The top and bottom edges of the fabric can be inserted first, and then the sides, or any desired sequence can be used. The fabric edge is folded over the edge of the long blade so that the blade and the fabric edge can be pushed inwardly along the outer surface of walls 28 (the end cap is off) past the teeth 62, the blade maintains the tension on the fabric panel, and once the edge of the fabric is past the teeth, the fabric edge (which is not very wide) can unfold from the blade and left as shown in FIG. 2 in chamber 67. The teeth 62 hold the stretched fabric cover panels in place as the insertion blade is withdrawn. Other ways of inserting the fabric edges can be used.

As can be seen in FIG. 2 the slots 70 are positioned just below the edge cap 78, and above the fabric retainer channel 50 so that the slots are unobtrusive, when the panels are in use, but can be readily accessed for supporting components such as cabinets, shelves, or the like.

Figure 5:
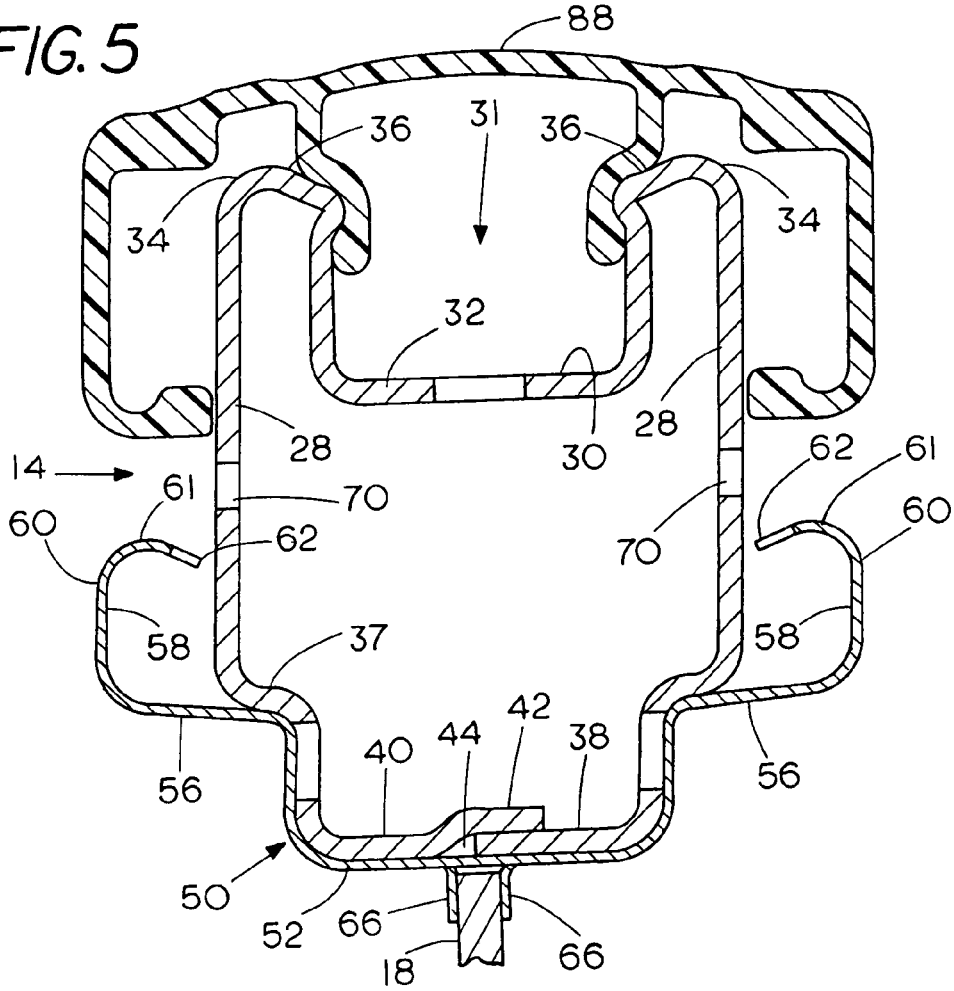
FIG. 5 is an enlarged sectional view of a frame tube similar to FIG. 2 with a different outer edge cap in place.

FIG. 5 shows a top frame member 14 with a different form of plastic top cap 88 in place. The frame tube 26 is the same construction as before, and has the same numerals for designating the parts.

The construction of the outer tubes forming the frame sections, with the overlapping flanges on the inner wall, and the fabric retainer channel secured directly to the inner wall by welding it through openings in the base of the fabric retainer channel permits a multi-part assembly of the frame sections, the fabric retainer channels have teeth to that provide an adequate retainer for the edges of the fabric cover panels. Since the fabric retainer channel is separately formed, it can have the outwardly formed tabs that will hold a center divider wall in place. The frame section tube can be rolled for forming, and welded closed in an easy operation.

The fabric retaining channel has the inwardly directed shoulders shown at 56 that fit against formed shoulders or offset sections 37 on the frame tube, so that it is supported on the tube. The curved wall portions 60 and the rounded surface 61 hold the fabric in place without tendency to tear because of the rounded surfaces for support. The upright wall portions 58 of the channel 50 form a support surface in the plane of the fabric panels.

It should be noted that the center divider 18 can be made of different materials, such as expanded metal, or other material that is relatively lightweight and gives support for the insulation that is provided, as well as for some lateral force resistance.

Although the present invention has been described with reference to preferred embodiments, workers skilled in the art will recognize that changes may be made in form and detail without departing from the spirit and scope of the invention.

What is claimed is:

1. A modular office panel comprising a frame having frame members joined together to form a panel section, the frame members comprising tubes formed to have spaced side walls, an outer edge wall, and an inner wall, the inner wall having overlapping flanges, a weld along the flanges to close the tube, and a separate fabric retainer secured to the inner wall of each frame member and having wall portions that extend toward an outer side of the tube frame members and spaced from the side walls of the respective frame member, the fabric retainer having in-turned edges, the edges having teeth extending toward the respective side wall for retaining fabric in place.

2. The modular office panel of claim 1, wherein the in-turned edges have rounded corners on outer sides thereof around which a panel of fabric fits.

3. The modular office panel of claim 2, wherein the teeth on the in-turned edges of each fabric retainer are closely adjacent to the side walls of the tube forming the respective frame member, with the fabric retainer in place on the respective frame member.

4. The modular office panel of claim 1, wherein said fabric retainer has partial punched out tabs on a base wall thereof that faces an interior of the frame, the partially punched out tabs being bent out of the plane of the base wall of the fabric retainer to form side guides for a divider wall positioned within the frame member.

5. The modular office panel of claim 1, wherein the fabric retainer in-turned edges are rounded at a radius in cross section such that a fabric panel held by the fabric retainer rests on a rounded surface adjacent to the in-turned edges having the teeth, and said rounded surface joining planar wall portions lie along a plane of support for such fabric panel.

6. The modular office panel of claim 1, wherein each said fabric retainer comprises a channel shaped member having a base that engages the overlapping flanges, and fits along the side walls of the respective frame member, the frame member having shoulders that extend generally perpendicular to a central plane of the frame, and which join the frame member side wall portion extending parallel to the plane of a frame, and said respective fabric retainer channel having lateral wall portions fitting against the shoulders of the respective frame member and extending laterally outwardly beyond the side walls of the respective frame member, the fabric retainer channel having side walls joining the lateral wall portions and extending parallel to the side walls of the respective frame member a selected distance to join the in-turned edges.

7. The modular office panel of claim 1, wherein each said separate fabric retainer comprises a channel member having a base lying along the overlapping flanges of the respective frame member, and said base having openings therein that form edges for welding the channel member to the respective frame member.

8. The modular office panel of claim 1, wherein the inner wall of each frame member formed by the overlapping flanges provides a generally planar support surface, and one flange being overlapped over the other in a center portion, such that the weld to close the tube is formed along a junction of the overlapping portions.

9. A frame member and a separately formed fabric retainer channel for a modular office panel, said frame member comprising a tube that is formed to include an outer edge wall, a pair of spaced apart side walls joining the outer edge wall, and an inner edge wall that faces inwardly when the frame is forming a panel, said inner edge wall being made with two flanges, each joining one of the side walls, and one of the flanges being offset to overlap the other flange along a generally central region of the inner edge wall, and the separately formed fabric retainer channel having a base which engages and rests against the inner edge wall and is welded thereto, said fabric retainer channel being preformed to include tabs punched partially out of the base and extending in direction away from the inner edge wall of the tube, said fabric retainer channel having fabric retainer channel side walls that extend upwardly and are spaced from at least portions of the side walls of the tube, and the fabric retainer channel side walls having edge portions that are formed into a radius and are extended back toward the side walls of the tube between the inner and outer edges of the tube, said in-turned edges of the fabric retainer channel having teeth that are configured to retain a fabric panel.

10. The frame member of claim 9, wherein the side walls of the tube have shoulders formed between the outer edge wall and the inner edge wall, and said fabric retainer channel having bent out wall portions that rest against the shoulders of the tube, and extend laterally outwardly to space the side walls fabric retainer channel from the side walls of the tube.

11. A modular office panel comprising a frame having frame members joined together to form a panel section, a top frame member comprising a tube formed to have spaced side walls, a top edge wall, and a lower inner wall, the side walls having outwardly offset shoulder walls spaced upwardly from the lower inner wall, and a separate fabric retainer channel having a base that engages the lower inner wall of the top frame channel, and first side wall portions that fit along the side walls of the top frame member adjacent the lower inner wall, the fabric retainer channel having lateral wall portions fitting against the shoulder of the top frame member and extending laterally outwardly beyond upper portions of the side walls of the top frame member, the fabric retainer channel having second side wall portions joining the lateral wall portions which are spaced from and extend upwardly parallel to the respective upper side wall portion of the top frame member a selected distance, and in-turned wall portions joining upper edges of the second side wall portions of the fabric retainer channel and being formed on a radius to provide a rounded surface that curves upwardly from upper edges of the second side wall portions and inwardly toward the respective upper side wall portions of the upper frame member, and each in-turned wall portion terminating in a toothed edge that is above the upper edge of the respective second side wall portion.

* * * * *